US010640905B2

(12) United States Patent
De Bernardo et al.

(10) Patent No.: US 10,640,905 B2
(45) Date of Patent: May 5, 2020

(54) LAUNDRY WASHING MACHINE AND CONTROL METHOD THEREOF

(71) Applicant: Electrolux Appliances Aktiebolag, Stockholm (SE)

(72) Inventors: Andrea De Bernardo, Pordenone (IT); Luca Da Re, Cordenons (IT)

(73) Assignee: Electrolux Appliances Aktienbolag, Stockholm (SE)

( * ) Notice: Subject to any disclaimer, the term of this patent is extended or adjusted under 35 U.S.C. 154(b) by 278 days.

(21) Appl. No.: 15/477,315

(22) PCT Filed: Sep. 25, 2015

(86) PCT No.: PCT/EP2015/072147

§ 371 (c)(1),
(2) Date: Apr. 3, 2017

(87) PCT Pub. No.: WO2016/050650

PCT Pub. Date: Apr. 7, 2016

(65) Prior Publication Data

US 2017/0226679 A1 Aug. 10, 2017

(30) Foreign Application Priority Data

Oct. 3, 2014 (EP) ..... 14187619

(51) Int. Cl.
*D06F 33/02* (2006.01)
*D06F 39/08* (2006.01)
(Continued)

(52) U.S. Cl.
CPC ..... *D06F 33/02* (2013.01); *D06F 35/005* (2013.01); *D06F 39/005* (2013.01);
(Continued)

(58) Field of Classification Search
None
See application file for complete search history.

(56) References Cited

U.S. PATENT DOCUMENTS 6,634,048 B1 10/2003 Hornung et al.
2007/0169283 A1* 7/2007 Kim ..... D06F 25/00 8/158
2010/0083445 A1* 4/2010 Kim ..... D06F 35/00 8/159

FOREIGN PATENT DOCUMENTS

EP 0355450 A2 2/1990
EP 2660379 A1 11/2013

OTHER PUBLICATIONS

International Search Report issued in corresponding International Application No. PCT/EP2015/072147, dated Nov. 26, 2015.

* cited by examiner

*Primary Examiner* — Cristi J Tate-Sims
(74) *Attorney, Agent, or Firm* — RatnerPrestia

(57) ABSTRACT

A laundry treatment machine (1) has an outer casing (2), and a washing tub (3) which is arranged inside the outer casing (2). A rotatable washing drum (4) is arranged in axially rotating manner inside the washing tub (3) and is structured to receive the laundry to be treated. A liquid supplying system is provided for supplying hot liquid and/or cold liquid into the washing tub (3). A temperature sensor (22) is arranged in the washing tub (3) and is designed for sensing the temperature of the liquid contained in the washing tub (3). An electronic control device (23) is configured to: determine whether the temperature sensor (22) is immersed in liquid; and perform a first or a second control procedure, different from one another, to control the water supplying system based on a determined immersion status of the temperature sensor (22).

11 Claims, 9 Drawing Sheets

(51) Int. Cl.

| | |
|---|---|
| ***D06F 35/00*** | (2006.01) |
| ***D06F 39/00*** | (2020.01) |
| ***D06F 39/04*** | (2006.01) |

(52) U.S. Cl.

CPC ..... *D06F 39/045* (2013.01); *D06F 39/085* (2013.01); *D06F 39/087* (2013.01); *D06F 39/088* (2013.01); *D06F 2202/04* (2013.01); *D06F 2204/088* (2013.01)

LAUNDRY WASHING MACHINE AND CONTROL METHOD THEREOF

The present invention concerns the field of laundry washing techniques.

In particular, the present invention refers to a control method of a laundry washing machine. More specifically, the present invention relates to a method for controlling the hot and cold water supplied into the washing tub of the laundry washing machine by electrovalves.

BACKGROUND ART

Nowadays the use of laundry washing machines, both "simple" laundry washing machines (i.e. laundry washing machines which can only wash and rinse laundry) and washing-drying machines (i.e. laundry washing machines which can also dry laundry), is widespread.

In the present description the term "laundry washing machine" will refer to both simple laundry washing machines and laundry washing-drying machines.

Laundry washing machines generally comprise an external casing provided with a washing tub inside which there is a rotatable perforated drum in which the laundry is placed.

Some known washing machines comprise a water supplying system provided with two valves for supplying hot water and cold water into the washing tub, a temperature sensor which is arranged inside the washing tub and is designed for sensing the temperature of the water supplied from the valves into the washing tub, and a control device for controlling the opening or closing of each valve based on the sensed temperature by the temperature sensor.

Methods of controlling of the temperature of the supplied water based on the temperature sensor are accurate if the temperature sensor is in contact with the water. However, temperature sensor is typically arranged at a prefixed height above the bottom surface of the washing tub, and consequently it is temporarily not able to provide the correct water temperature during the first water wetting phase, wherein the supplied water takes time to reach a level in the washing tub to cause the temperature sensor to be immerged in the water. This condition may also happen during the following wetting phases, since water level can decrease because water is absorbed by the laundry, and also, if the machine is provided with a recirculation circuit, since because during recirculation water is drained from the bottom of the washing tub to be re-admitted into an upper region of the tub.

In both the above disclosed temporary conditions, the control of valves is therefore made according to a wrong/undetermined temperature, causing the temperature of the water supplied into the washing tub to be heavily different from the prefixed washing temperature of the washing program.

Of course, although temporary, filling water with wrong temperature into the washing tub, on the one side may cause the problem that laundry in the washing tub may be damaged, in particular if hot water is supplied to some kind of delicates laundry, and, on the other side, it requires an amount of time to be corrected, which may be longer than available time of the laundry wetting phase of the selected program, in particular in case of short program.

SUMMARY OF SELECTED INVENTIVE ASPECTS

Therefore it is an object of the present invention to provide a method to control a laundry washing machine wherein the valves for supplying hot and cold water are controlled in order to solve the above problems.

It is another object of the invention to provide a method to control a laundry washing machine by which the delicate laundry can avoid being damaged by hot water flowing into the washing tub.

It is another object of the invention to provide a method to control a laundry washing machine by which the temperature of the water supplied into the washing tub is conveniently controlled also when the temperature sensor is not submerged by the water.

Applicant has found that by determining an immersion status of the temperature sensor, and by performing a first or a second control procedure, different one another, to control the water supplying system based on a determined immersion status of the temperature sensor, it is possible to control the valves for supplying hot and cold water in a very reliable way.

According to an aspect of the present invention, there is provided a laundry treatment machine comprising an outer casing, a washing tub which is arranged inside the outer casing, a rotatable washing drum, which is arranged in axially rotating manner inside the washing tub and is structured to receive the laundry to be treated, a liquid supplying system for supplying hot liquid and/or cold liquid into said washing tub, a temperature sensor which is arranged into the washing tub and is designed for sensing the temperature of the liquid contained in said washing tub; an electronic control device configured to determine whether the temperature sensor is immersed into liquid, perform a first or a second control procedure, different one another, to control said water supplying system based on a determined immersion status of said temperature sensor.

Preferably, the electronic control device is configured to perform said first control procedure if said temperature sensor is not immersed into liquid; or perform said second control procedure if said temperature sensor is immersed into liquid.

Preferably, the laundry treatment machine comprises a user interface provided for an operator to select a washing program and/or parameter, wherein in said first control procedure, said control device controls said liquid supplying system in such a way that hot liquid and/or cold liquid is supplied into the washing tub according to a pre-established hot/cold liquid supplying order depending on a selected washing program and/or parameter selected by a user by said user interface.

Preferably, the selected washing program and/or parameter on which said pre-established hot/cold liquid supplying order depends, is associated with washing temperature.

Preferably, in said second control procedure said electronic control device controls said water supplying system based on the liquid temperature sensed by said temperature sensor.

Preferably, the selected program and/or parameter on which said pre-established hot/cold liquid supplying order depends is associated with washing temperatures comprised between prefixed maximum and minimum temperatures.

Preferably, the electronic control device is configured to perform a third control procedure wherein said liquid supplying system is controlled based on the temperature sensed by said temperature sensor into the tub Preferably, the electronic control device is configured to perform the third control procedure after performing the first control procedure and after performing the second control procedure.

Preferably, said selected program and/or parameter on which said pre-established hot/cold liquid supplying order depends is associated with washing temperatures comprised between prefixed maximum and minimum temperatures); in said third control procedure the control device compares said sensed temperature with said maximum and/or minimum temperatures, and controls said liquid supplying system based on the comparison.

Preferably, said liquid supplying system comprises a first valve for supplying hot liquid and a second valve for supplying cold liquid, wherein in said third control procedure the first valve is opened if the temperature sensed by said temperature sensor is lower than minimum temperature; the second valve is opened if the temperature sensed by said temperature sensor is greater than said maximum temperature.

Preferably, in said second control procedure the control device calculates an average temperature based on said minimum temperature and said maximum temperature, compares temperature sensed by said temperature sensor with said average temperature, and controls said liquid supplying system based on the result of comparison.

Preferably, in said second control procedure the first valve is opened if the temperature sensed by said temperature sensor is lower than said average temperature; and the second valve is opened if the temperature sensed by said temperature sensor is greater than said average temperature.

Preferably, laundry treatment machine comprising an electric heating device arranged into the washing tub for heating the liquid 1 in the washing tub, said temperature sensor being integrated in, and supported by, said electric heating device.

The present invention further relates to a control method of a laundry treatment machine comprising an outer casing, a washing tub which is arranged inside the outer casing, a rotatable washing drum, which is arranged in axially rotating manner inside the washing tub and is structured to receive the laundry to be treated, a water supplying system for supplying hot liquid and/or cold liquid into said washing tub, a temperature sensor which is arranged into the washing tub and is designed for sensing the temperature of the liquid contained into said washing tub; the method comprises: determining whether the temperature sensor is immersed into the liquid; controlling said liquid supplying system by a first or second control procedure, different one another, based on a determined immersion status of said temperature sensor.

Preferably, the method comprises performing said first control procedure if said temperature sensor is not immersed into liquid; or performing said second control procedure if said temperature sensor is immersed into liquid.

Preferably, laundry treatment machine comprises a user interface provided for an operator to select washing programs and/or parameter, wherein the method performs the first control procedure to control said liquid supplying system so that hot liquid and/or cold liquid is supplied into the washing tub according to a pre-established hot/cold water supplying order depending on a selected washing program and/or parameter selected by a user by said user interface.

Preferably, the selected program and/or parameter on which said pre-established hot/cold liquid supplying order depends, is associated with washing temperature.

Preferably, the method comprises a third control procedure wherein said liquid supplying system is controlled based on the temperature sensed by said temperature sensor into the tub; clearly in this case the temperature sensed by the temperature sensor is air temperature, since temperature sensor is not immersed into liquid.

Preferably, the third control procedure is performed after performing the first control procedure and after performing the second control procedure.

Preferably, said selected program and/or parameter on which said pre-established hot/cold liquid supplying order depends is associated with washing temperatures comprised between prefixed maximum and minimum temperatures; in said third control procedure the control device compares said sensed temperature with said maximum and/or minimum temperatures, and controls said liquid supplying system based on the comparison.

Preferably, said liquid supplying system comprises a first valve for supplying hot liquid and a second valve for supplying cold liquid, wherein in said third control procedure the first valve is opened if the temperature sensed by said temperature sensor is lower than minimum temperature; the second valve is opened if the temperature sensed by said temperature sensor is greater than said maximum temperature.

Preferably, in said second control procedure the control device calculates an average temperature based on said minimum temperature and said maximum temperature, compares temperature sensed by said temperature sensor with said average temperature, and controls said liquid supplying system based on the result of comparison.

Preferably, in said second control procedure the first valve is opened if the temperature sensed by said temperature sensor is lower than said average temperature and the second valve is opened if the temperature sensed by said temperature sensor is greater than said average temperature.

Preferably, laundry treatment machine comprising an electric heating device arranged into the washing tub for heating the liquid 1 in the washing tub, said temperature sensor being integrated in, and supported by, said electric heating device.

BRIEF DESCRIPTION OF THE DRAWINGS

Further characteristics and advantages of the present invention will be highlighted in greater detail in the following detailed description of some of its preferred embodiments, provided with reference to the enclosed drawings. In the drawings, corresponding characteristics and/or components are identified by the same reference numbers. In particular.

DETAILED DESCRIPTION OF EXAMPLE EMBODIMENTS

The control method of the present invention has proved to be particularly advantageous when applied to a laundry washing machine, as described below. It should be understood that although the control method is described with reference to a laundry washing machine, other applications are contemplated. As can be appreciated, the present invention can be conveniently applied to other laundry treatment machines, like for example laundry washing and drying machines (called also washer/driers).

Figure 1:
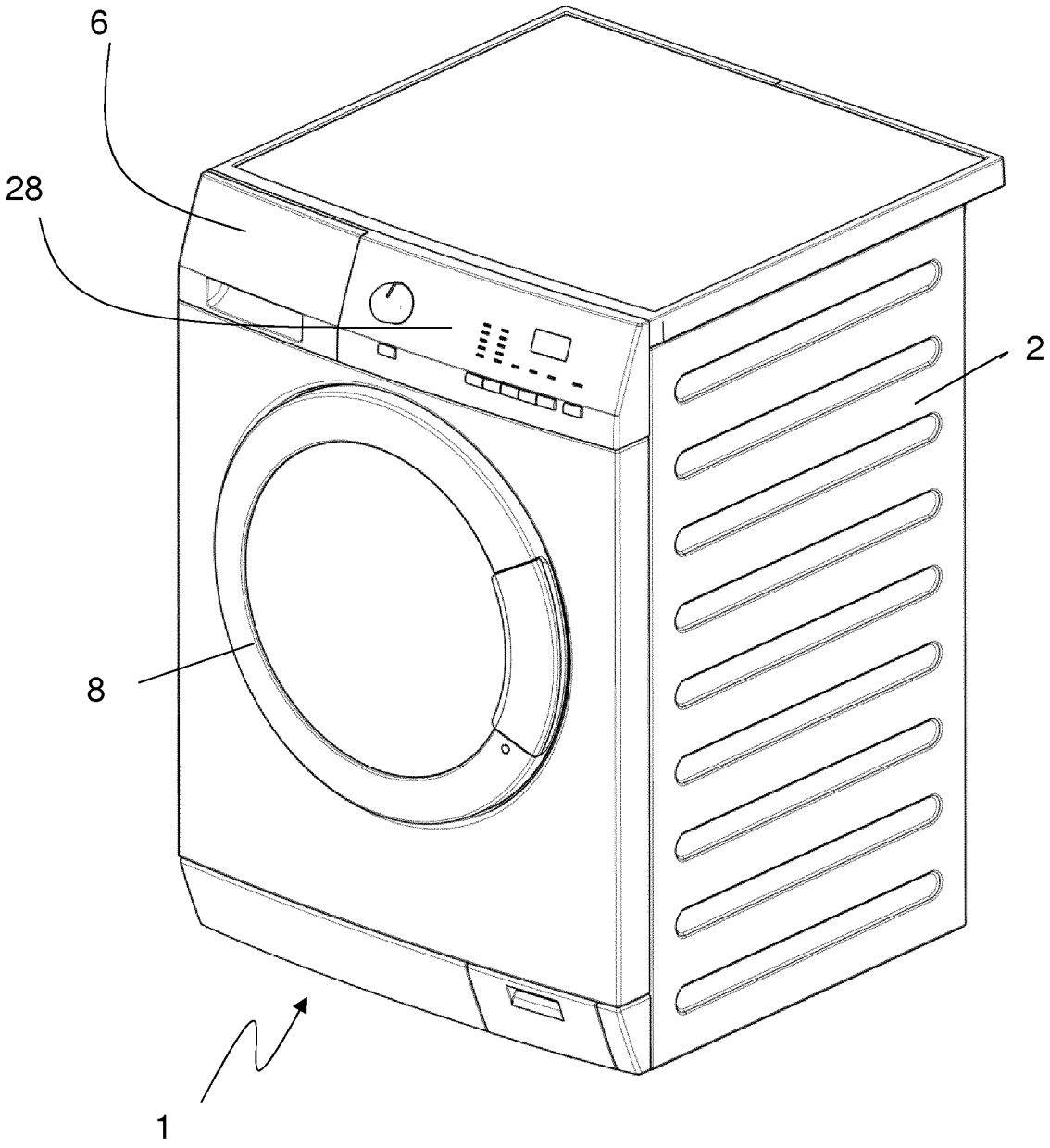
FIG. 1 shows a front view of a laundry washing machine implementing the control method according to the present invention.
Figure 2:
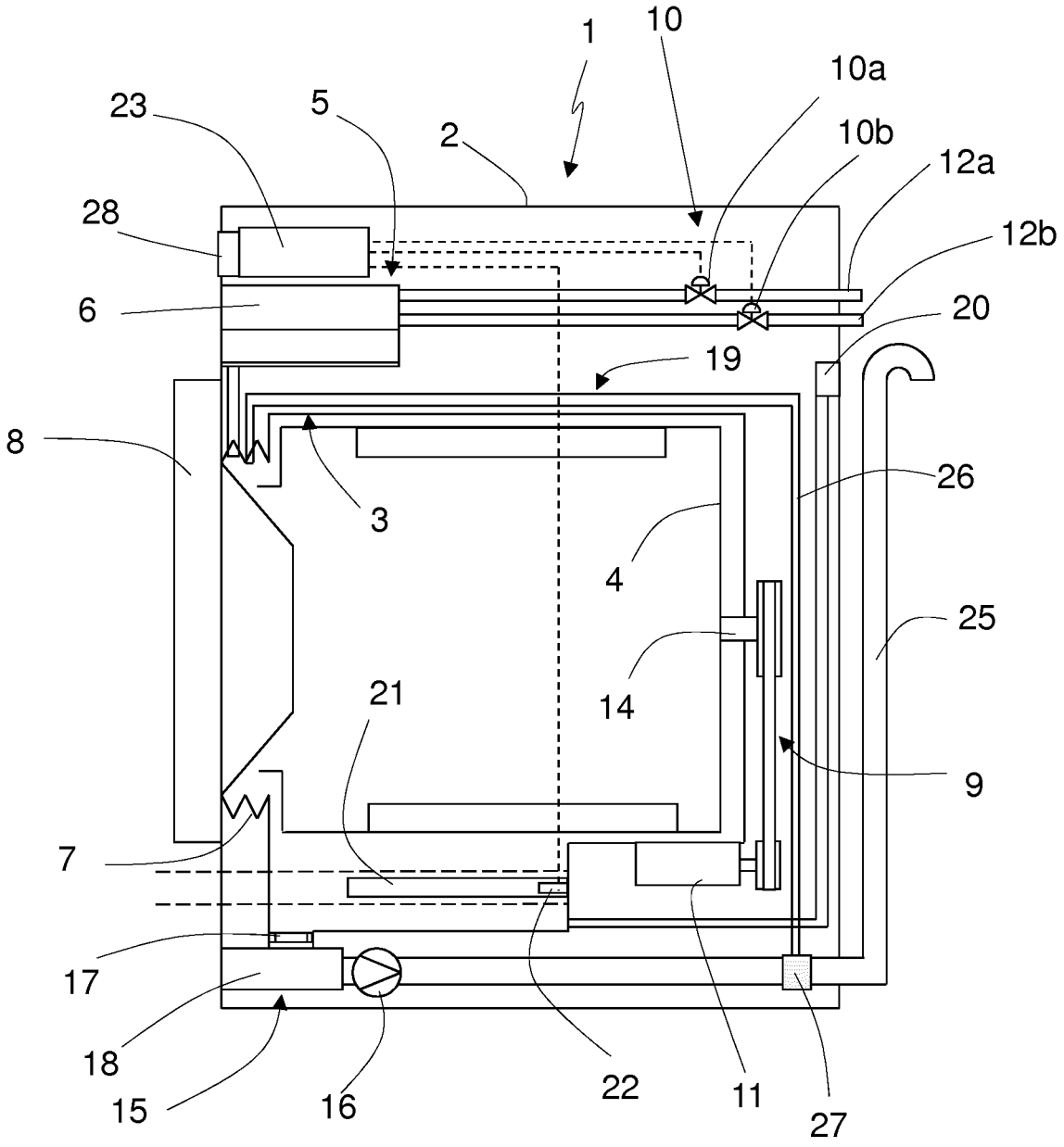
FIG. 2 schematically illustrates a side view of the laundry washing machine shown in FIG. 1.

With reference to FIG. 1 and FIG. 2, a laundry washing machine 1 is illustrated, in which a control method according to the present invention is advantageously performed. The laundry washing machine 1 comprises an external casing or housing 2, in which a washing tub 3 is provided that contains a rotatable perforated drum 4, where the laundry (not illustrated) to be washed can be loaded. The housing 2 is provided with a loading/unloading door 8 which allows access to the washing tub 3 and the drum 4.

The tub 3 and the drum 4 both have preferably a substantially cylindrical shape. A hollow space is defined between the tub 3 and the drum 4.

The tub 3 is preferably suspended in a floating manner inside the housing 2, advantageously by means of a number of coil springs and shock-absorbers that are not illustrated herein.

The tub 3 is preferably connected to the casing 2 by means of an elastic bellows 7, or gasket.

The drum 4 is advantageously rotated by an electric motor 11 which preferably transmits the rotating motion to the shaft 14 of the drum 4, advantageously by means of a belt/pulley system 9. In a different embodiment of the invention, the motor 11 can be directly associated with the shaft 14 of the drum 4.

A water inlet circuit 5 is arranged, preferably in the upper part of the laundry washing machine 1 and is designed to supply liquid, i.e. water and washing/rinsing products (i.e. detergent, softener, etc.) into the washing tub 3. The water inlet circuit 5 advantageously comprises a removable drawer 6 provided with various compartments suited to be filled with washing and/or rinsing products. In the embodiment herein described, the water is supplied into the washing tub 3 by making it flow through the drawer 6.

In a preferred embodiment, the water which reaches the tub 3 can selectively contain one of the products contained in the compartments of the drawer 6, or such water can be clean, and in this case it may reach the tub 3 directly, bypassing the compartments of the drawer 6.

In an alternative embodiment of the invention, a further separate water supply pipe can be provided, which supplies exclusively clean water into the tub 3.

The water inlet circuit 5 advantageously comprises a water supplying system 10 provided with valves 10*a* and 10*b* which are arranged along two respective water supplying pipes 12*a* and 12*b* for supplying, on command, hot water (hot valve 10*a*) and cold water (hot valve 10*b*) into the washing tub 3 preferably, but not necessarily, through the drawer 6. The valves 10*a* and 10*b* are electro-valves designed to selectively open/close the water supplying pipes 12*a* and 12*b* based on an electrical command.

The water supplying system 10 of a laundry washing machine 1 is well known in the art, and therefore will not be described in detail.

Laundry washing machine 1 advantageously comprises a water outlet circuit 15.

The water outlet circuit 15 advantageously comprises a drain pump 16, a first pipe 17 connecting the tub 3 to the drain pump 16 and an outlet pipe 25 ending outside the housing 2. The water outlet circuit 15 is designed to drain the liquid, i.e. dirty water or water mixed with washing and/or rinsing products, from the tub 3 to the outside of the washing machine 1.

The water outlet circuit 15 advantageously comprises a filtering device 18 placed along the first pipe 17, between the bottom of the tub 3 and the drain pump 16 and designed to retain all the undesirable bodies (for example buttons that have come off the laundry, coins erroneously introduced into the laundry washing machine, etc.) that have passed through the holes located on the surface of the drum 4, or fallen onto the bottom of the tub 3 while passing between the drum 4 and the tub 3, which could damage or obstruct the drain pump 16.

The water outlet circuit 15 can be advantageously provided with a recirculation circuit 19 designed to drain the washing/rinsing liquid from the bottom of the washing tub 3, and to re-admit such liquid into an upper region of the washing tub 3, for improving the wetting of the laundry. In accordance with an example illustrated in FIG. 2, the recirculation circuit 19 may comprise a recirculation pipe 26 having an upper ending arranged so that the washing/rinsing liquid is supplied into the washing tub 3, and an electro-valve 27, which may be arranged on the outlet pipe 25 and/or the recirculation circuit 19 and is designed to connect the outlet of the drain pump 16 with the outlet pipe 25 during the draining phase, or alternately the outlet of drain pump 16 with the recirculation pipe 26 during the recirculating phase.

Advantageously laundry washing machine 1 further comprise a water level detector 20 designed to sense (or detect) the water level inside the washing tub 3. In accordance with a preferred embodiment illustrated in FIG. 2, the water level detector 20 may comprise a pressure sensor which senses the pressure in the washing tub 3, which value is related to the level of free water contained in the washing tub 3. In another embodiment, not illustrated, laundry washing machine 1 advantageously comprises (in addition to, or as a replacement of, the pressure sensor) a level sensor (for example mechanical, electro-mechanical, optical, etc.) designed to sense (or detect) the water level inside the washing tub 3.

According to a preferred embodiment illustrated in FIG. 2, the laundry washing machine 1 further comprises a heating element 21, contained preferably in a suitable seat (not illustrated), obtained advantageously at the bottom of the tub 3. In accordance with the exemplary embodiment shown in FIG. 2, the heating element 21 may comprise an electric resistor designed to come into contact with the liquid, i.e. water, or water and detergent, present on the bottom of the washing tub 3 to heat said liquid. In accordance with a possible embodiment the seat is a sump (not illustrated) of the washing tub 3 and the heating element 21 is arranged in such a way to be at least partially placed within the sump of the washing tub 3.

Laundry washing machine 1 further comprises a temperature sensor 22 for sensing the temperature of the liquid/water present in the tub 3. In accordance, with a preferred embodiment illustrated in FIG. 2, the temperature sensor 22 may be arranged at a prefixed height above the bottom surface of the washing tub 3. Preferably but not necessarily, the temperature sensor 22 may be a NTC (Negative Temperature Coefficient) thermal resistor supported by the heating element 21. For example the temperature sensor 22 may be fixed to, integrated in, connected with, the heating element 21.

It is pointed out that the present invention is not limited to a temperature sensor 22 arranged into the washing tub 3, but it may comprise a temperature sensor placed into the sump and/or any other component of the washing machine (pipes) hydraulically connected with the washing tub 3, such as for example the outlet pipe 22.

In accordance with the example illustrated in FIG. 2, laundry washing machine 1 further comprises a control device 23 electrically connected to the electrical/electronic devices/components of the laundry washing machine 1 for controlling the functions of the machine 1 in order to perform washing programs.

The control device 23 is electrically connected at least with: the valves 10*a* and 10*b* to selectively open/close the same, the temperature sensor 22 to receive the sensed temperature of the water, the water level detector 20 (pressure sensor or the level sensor) to receive information related to the level of the liquid supplied into the tub 3 and the electric motor 11 to control the rotation of the drum 4.

In accordance with the preferred embodiment illustrated in FIGS. 1 and 2, laundry washing machine 1 further comprises a user interface or control panel 28 which is electrically connected with the control device 23, and is designed so that the user may select and/or set washing commands. Washing commands may comprise, for example, a washing program and/or other input parameters associated with washing temperatures. Input parameters may comprise a number of selectable washing temperature levels each associated with a respective washing temperature range. In accordance with a preferred embodiment, selectable washing temperature levels may comprise, for example, a cold level, a warm level and a hot level.

Based on the parameters inputted by the user through the control panel 28, the control device 23 sets and controls the various parts of the laundry washing machine 1 in order to carry out the selected washing program.

Figures from 3 to 9 are flow chart diagrams of the steps followed by the control device 23 to perform an advantageous embodiment of the control method according to the present invention.

In the block 100 the user selects the washing program and/or the parameters. For clarity reasons, it will be supposed hereinafter that user selects a washing program and a temperature level: cold level, or warm level, or hot level. Anyway the temperature level can be already associated to a washing program, so that by selecting a washing program the temperature level is automatically set.

After the selection of washing programme and parameters, control device 23 starts the washing program (block 105). Preferably although not necessarily, control device 23 performs a pre-load water procedure (block 110) and a main load water procedure (block 115) wherein it preferably controls the valves 10*a* and 10*b* according to valves control procedures hereinafter disclosed to supply hot/cold water into the washing tub 3. In another advantageous embodiment, not illustrated, the pre-load water procedure can be avoided.

After executing the main load procedure (block 115), machine 1 preferably sequentially performs a maintenance phase (block 120), wherein the laundry is tumbled for detergent action, a drain phase wherein the water is drained from tub 3, and a spin phase (step of spinning the drum) (block 125), a rinse phase (block 130), wherein water is loaded into the washing tub, laundry is tumbled and liquid is drained from the tub 3, and a final spin/drain phase (bock 135). The maintenance phase (block 120), the drain/spin phase (block 125), the rinse phase (block 130) and the final spin/drain phase (block 135) are well known in the art, and therefore will not be described in detail.

Figure 8:
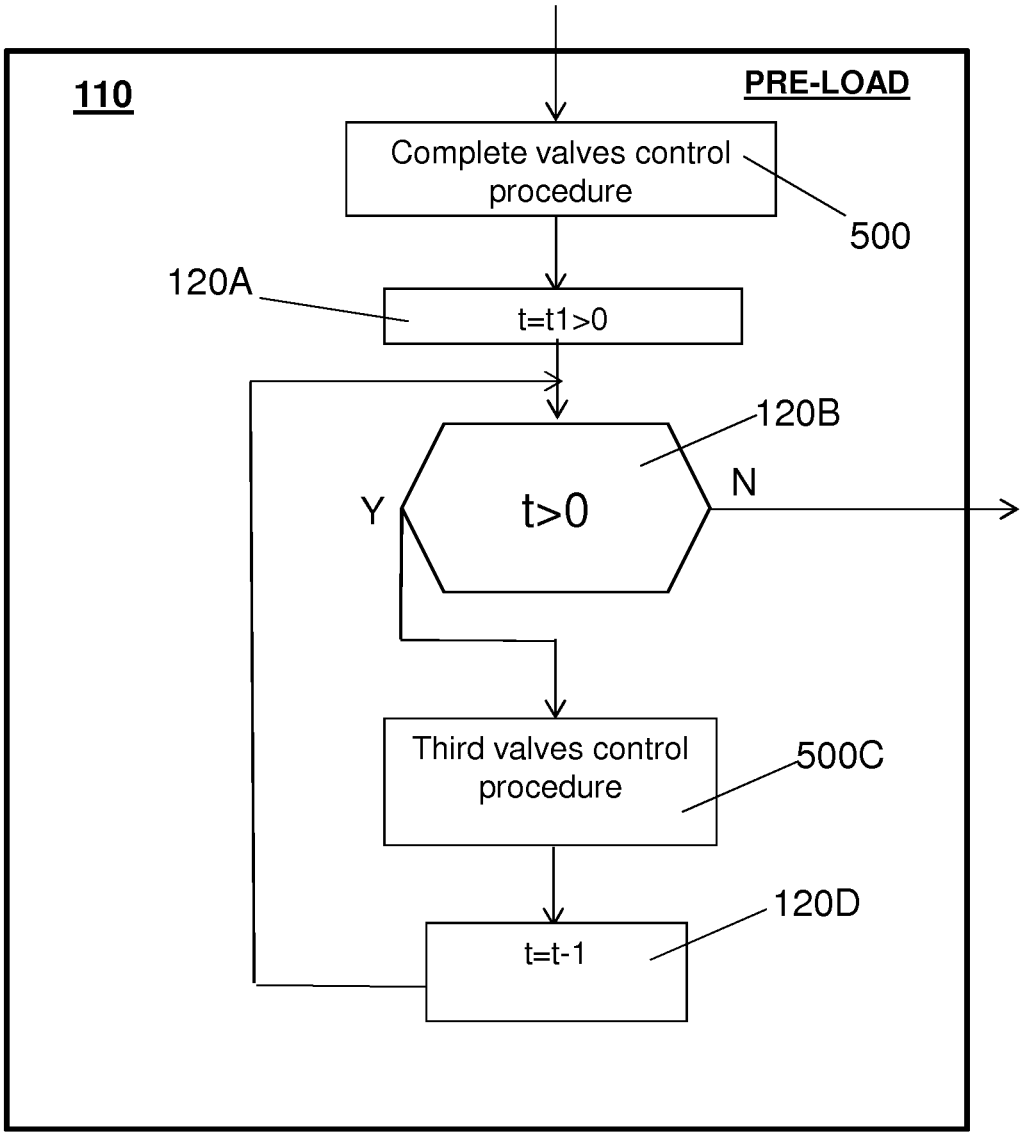

With reference to FIG. 8, the pre-load water procedure advantageously comprises the step of performing a complete valves control procedure 500, that will be better described in the following. After performing the complete valves control procedure 500, the control passes to block 120A wherein a time value t is set to a prefixed time t1 associated with the duration of the pre-load water procedure.

After setting the time value t, the control passes to block 120B wherein it is determined if the time value t is greater than zero.

Figure 3:
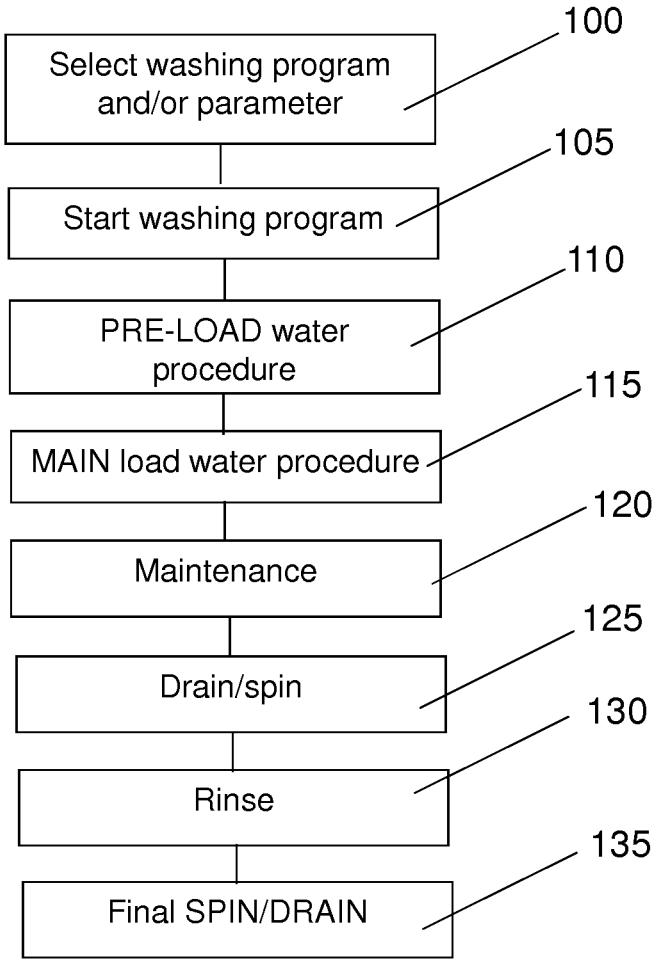
FIGS. 3 to 9 illustrate flow charts comprising the sequence of phases performed by an advantageous embodiment of the control method according to the present invention.

If the answer is negative, the control exits the pre-load phase 110, and, as shown in FIG. 3, passes to the block 115 wherein the main load water procedure 115 (hereinafter disclosed) is performed.

In block 120B if the answer is affirmative, i.e. time value t is greater than zero (outlet yes from block 120B), the control passes to the block 500C wherein a third control valves procedure (hereinafter disclosed) is performed.

After performing the third control valves procedure 500C, time value is decremented by one, and the method performs again the control of block 120B.

Figure 4:
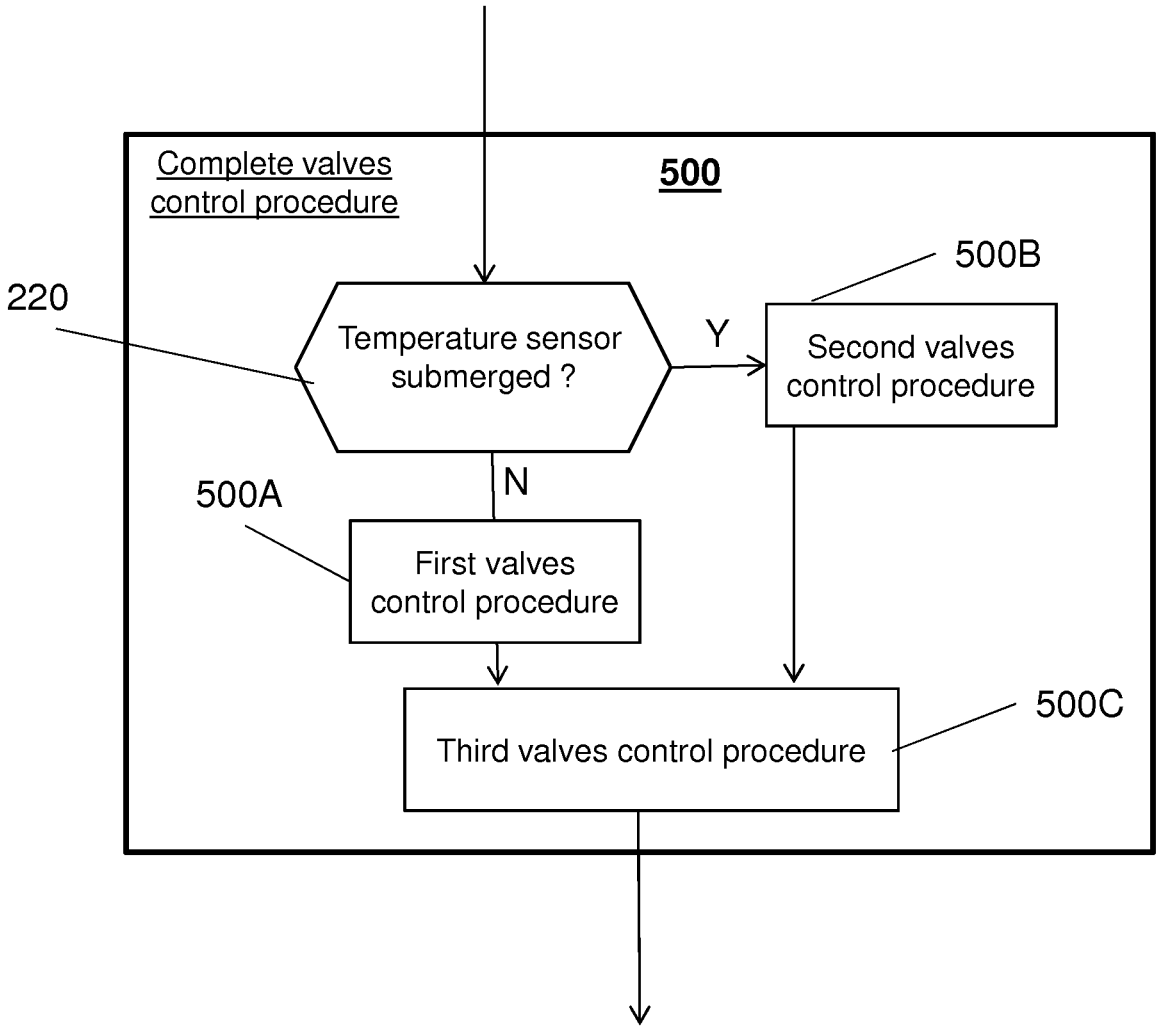

FIG. 4 illustrates in detail the steps performed by the complete valves control procedure 500; the latter firstly comprises the step of detecting if the temperature sensor 22 is immersed into the liquid (block 220). Preferably, water level detector 20 detects the level of liquid into the tub 3 and the control device 23 determines if the temperature sensor 20 is immersed into the liquid based on the measured level. For example control device 23 may determine if the temperature sensor 22 is submerged in the liquid by comparing the measured level of liquid into the tub 3 with the height of the temperature sensor 22 (measured from the bottom part of the washing tub 3, and stored in the memory of the control device 23). In this phase, control device 23 determines whether the temperature sensor 22 is immersed into liquid and performs a first or a second control procedures, different one another, to control the water supplying system 10 based on a determined immersion status of the temperature sensor 22, that is based on the fact that the temperature sensor 22 is immersed or not immersed into liquid.

If the control device 23 determines that the temperature sensor 22 is immersed into the liquid (YES output from block 220) the control device 23 performs a second valves control procedure 500B hereinafter disclosed.

On the contrary, if the control device 23 determines that the temperature sensor 22 is not immersed into the liquid (No output from block 220) the control performs a first valves control procedure 500A hereinafter disclosed.

In complete valves control procedure 500, both after performing the second valves control procedure 500B and the first valves control procedure 500A, a third valves control procedure 500C is performed, after which the control exits the complete valves control procedure 500.

Figure 5:
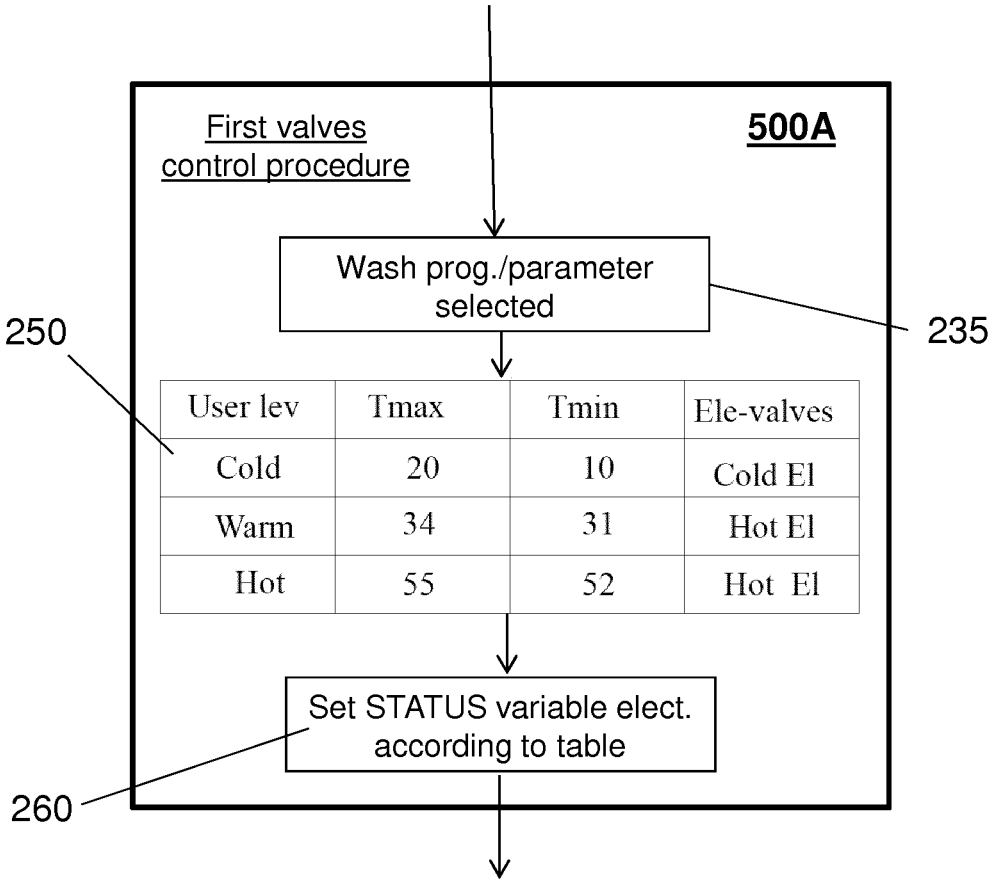
Figure 6:
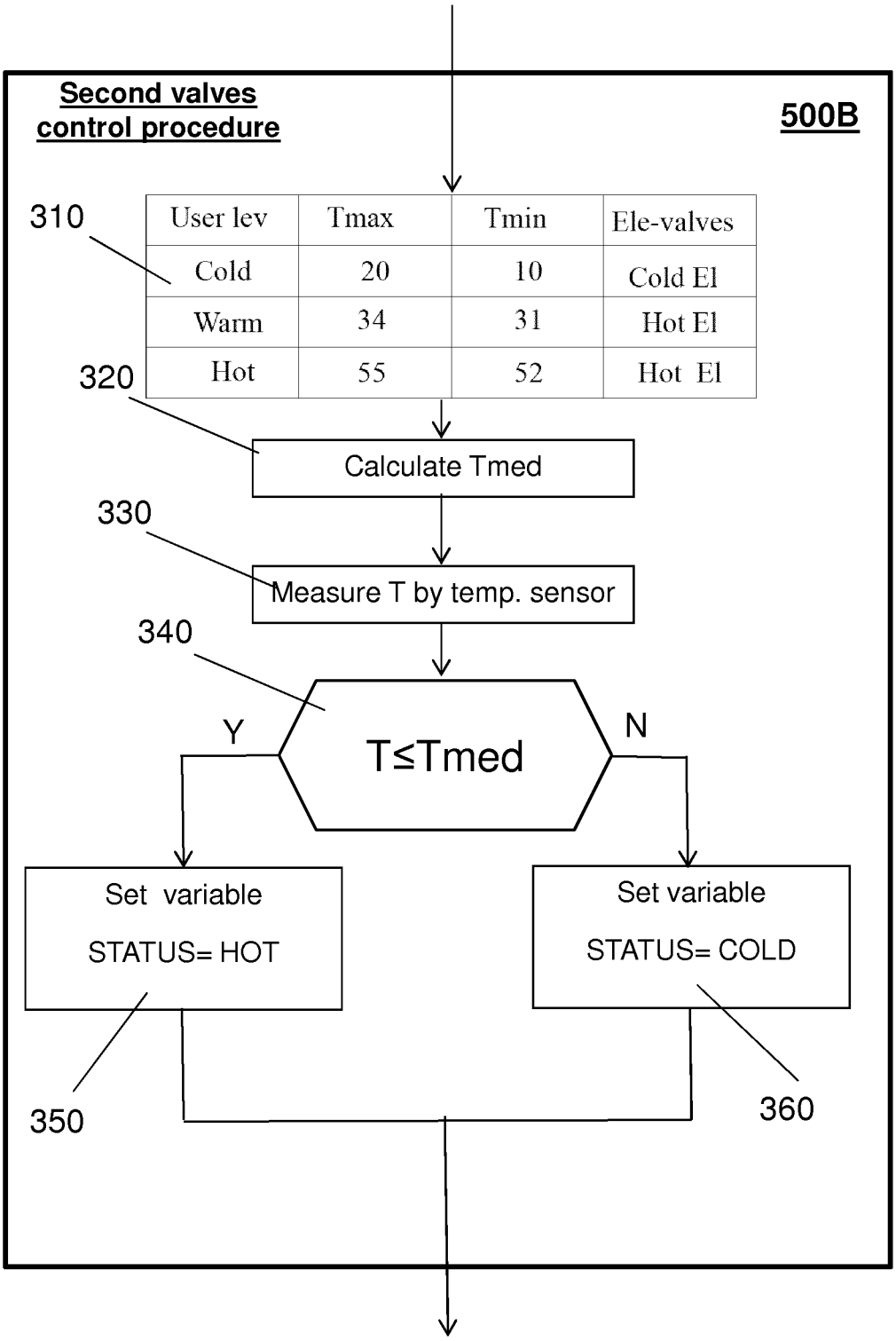
Figure 7:
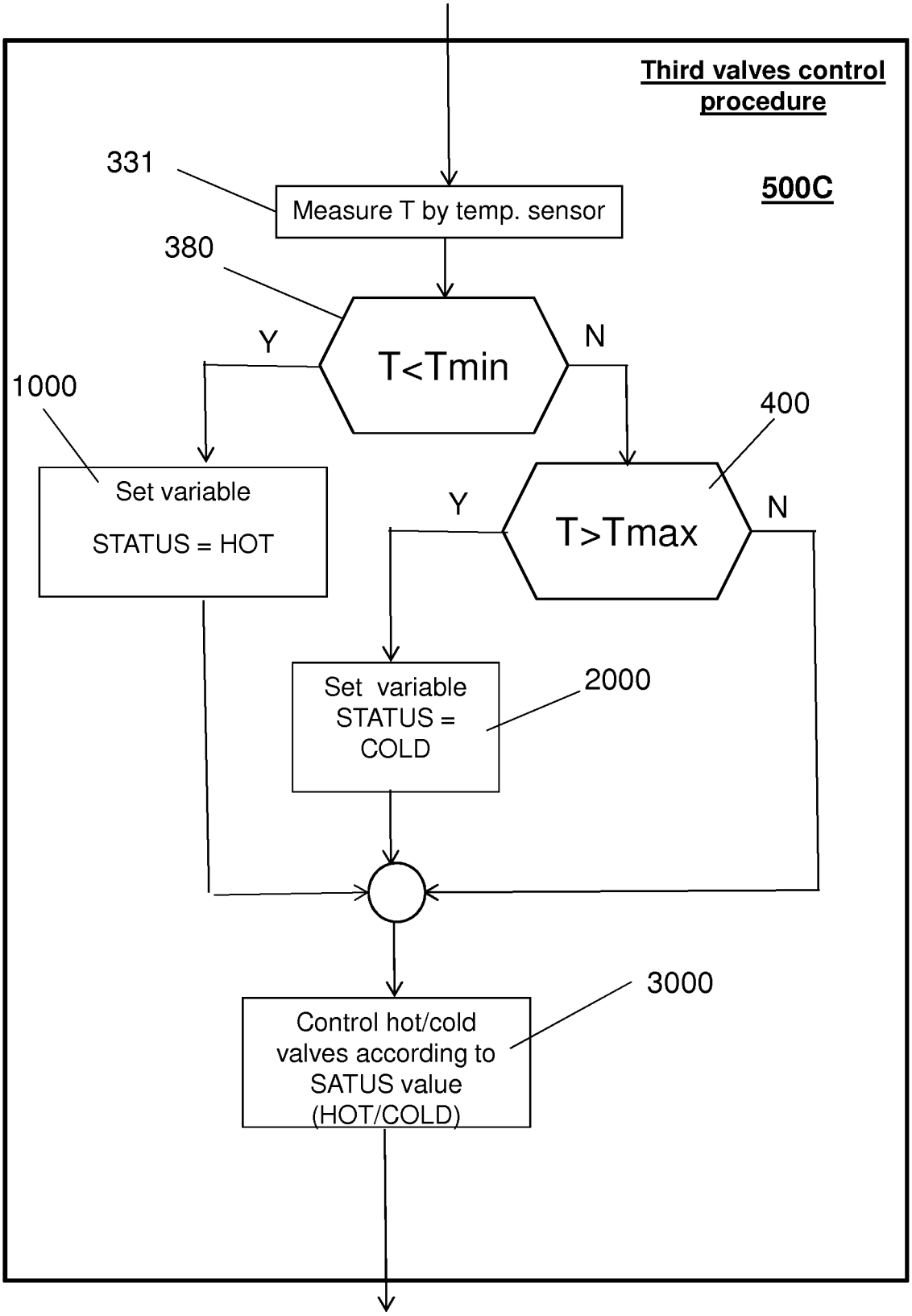

FIGS. 5, 6 and 7 illustrate in detail respectively the first, second, and third valves control procedures 500A, 500B, 500C.

FIG. 5 illustrates in detail the steps performed by the first valves control procedure 500A; first valves control procedure 500A starts with block 235 in which the control device 23 checks the washing program and/or parameters selected by the user.

After checking the parameter, the control device 23 determines the washing temperature/s associated with the selected washing program/parameters, and assign (block 260) a value to a variable "STATUS", indicating which of the valves 10*a*, 10*b* has to be opened/closed. Hereinafter it will be supposed that variable status may be set with two possible values, namely "HOT" or "COLD", wherein HOT status causes the control device 23 to open the valve 10*a* and close the valve 10*b*, while the COLD status causes the control device 23 to open the valve 10*b* and close the valve 10*a*.

It is underline that in block 260 the value of "STATUS" is simply assigned, but the valves 10*a* and 10*b* are not actually operated; actual opening and closing of valves 10*a*, 10*b*, performed according to the current value of variable "STATUS", will be performed in a further step (block 3000), as will be better described in the following.

The block 250 in FIG. 5 illustrates an example of a table memorized in the control device 23 containing the data relating to pre-established hot/cold liquid supplying order. The table (block 250) comprises pre-established hot/cold liquid supplying order wherein three temperature levels may be selected by the user.

In accordance with the exemplary embodiment, the temperature levels may comprise a cold level, a warm level, a hot level. Each temperature level may be associated with a range of temperature comprised between a maximum temperature Tmax and a minimum temperature Tmin. Each range of temperature may be associated in turn with pre-established valves 10*a* and/or 10*b* to be opened/closed.

According to the example of a pre-established hot/cold liquid supplying order illustrated in table (block 250), cold level is associated with pre-established commands to assign to STATUS variable the value "COLD"; warm level is associated with pre-established commands to assign to STATUS variable the value "HOT"; hot level is associated with pre-established commands to assign to STATUS variable the value "HOT".

After checking the wash program and/or parameters selected by user, control device 23 assigns to variable STATUS value HOT or COLD based on temperature associated with user selection.

After setting the valves variable STATUS, the control device 23 exits first valves control procedure 500A.

FIG. 6 illustrates the steps performed by the machine 1 during the second valves control procedure 500B.

In the second control procedure 500B, the control device 23 preferably firstly determines the minimum temperature Tmin and maximum temperature Tmax of the water based of washing program and/or the parameters selected by user (block 310). In accordance with the example illustrated in FIG. 6, user selects a temperature level (cold or warm or hot) and the control device 23 determines the range of temperature (Tmin–Tmax) associated with the selected temperature level.

Control device 23 advantageously passes to the block 320, wherein the control device 23 calculates an average temperature Tmed based on determined minimum and maximum temperatures Tmin, Tmax of the pre-established range of temperature, by performing: Tmed=(Tmax–Tmin)/2.

Control device 23 advantageously passes to the block 330, wherein an inquiry is made through the temperature sensor 22 to determine if the temperature sensed by the temperature sensor 22 is lower than or equal to the calculated average temperature Tmed (block 340).

If the answer to the inquiry is affirmative (Yes output from block 340), control device 23 sets the variable STATUS with HOT (block 350).

If the answer to the inquiry is negative (No output from block 340), that is, temperature sensed by temperature sensor 22 is greater than the average temperature Tmed, the control device 23 sets the variable STATUS with COLD (block 360).

Then, in both cases (i.e. after performing block 350 and after performing block 360), control device 23 exits second valves control procedure 500B.

FIG. 7 illustrates the steps performed by the machine 1 during the third valves control procedure 500C.

Third valves control procedure 500C starts by detecting the temperature sensed by temperature sensor 22 (block 331), and checks if this temperature is lower than the minimum temperature Tmin (block 380).

If the answer to the inquiry is affirmative (Yes output from block 380), that is the sensed temperature is lower than the minimum temperature Tmin, control device 23 sets the variable STATUS whit HOT (block 1000).

If the answer to the inquiry is negative (output No from block 380), that is the sensed temperature is equal or greater than the minimum temperature Tmin, the control device 23 detects through the temperature sensor 22 if the temperature is greater than the maximum temperature Tmax (block 400).

If the sensed temperature is greater than maximum temperature Tmax (output Yes from block 400), control device 23 sets the variable STATUS with COLD (block 2000). After assigning a value to variable STATUS the control device 23 controls valves 10*a*, 10*b* according to the current value of variable STATUS (block 3000). If current value of STATUS is COLD, then cold valve 10*b* is opened and hot valve 10*a* is closed, while if current value of STATUS is HOT, then hot valve 10*a* is opened and cold valve 10*b* is closed.

Then control device 23 exits third valves control procedure 500C.

It is underlined that if the third valves control procedure 500C is performed when the temperature sensor 22 is not submerged, the temperature detected in block 331 is the temperature of the air present in the tub 3, since sensor 22 is not submerged in liquid, but it is in air.

This is the case of a situation in which the third valves control procedure 500C is performed during the complete valves control procedure 500, in case the temperature sensor is not submerged (exit No from block 220), after having performed the first valves control procedure 500A; in this case if the answer to the inquiry of block 380 of the third control procedure is affirmative (Yes output from block 380), that is the temperature is lower than the minimum temperature Tmin, control device 23 sets the variable STATUS whit HOT (block 1000). In this case therefore, if detected temperature is lower than Tmin (meaning that air temperature is very low), STATUS is set as HOT independently on its previous value set in step 260 of the first valves control procedure performed before; in this way it is ensured that cold valve isn't opened if air temperature is already very low. If the answer to the inquiry of block 380 of the third control procedure is negative (output No from block 380), that is the temperature of air is equal or greater than the minimum temperature Tmin, the control device 23 detects through the temperature sensor 22 if the temperature of the air is greater than the maximum temperature Tmax (block 400). If the temperature of the air measured by the sensor 22 is greater than maximum temperature Tmax (output Yes from block 400), control device 23 sets the variable STATUS with COLD (block 2000). In this case therefore, if air temperature is higher than Tmax (meaning that air temperature is very high), STATUS is set as COLD independently on its previous value set in step 260; in this way it is ensured that hot valve wouldn't be opened if air temperature is already very hot. If air temperature detected in block 330 of the third valves control procedure 500C is comprised between Tmin and Tmax (exit No from block 400), the value of STATUS value is not changed, and therefore it is kept the value assigned during the previous first valves control procedure 500A. In this case the third control valves procedure 500C is performed when the temperature sensor 22 is submerged into the liquid (for example if the third valves control procedure 500C is performed during the complete valves control procedure 500 in case the temperature sensor is submerged—exit YES from block 220—), the temperature detected by sensor 22 in block 331 is the temperature of liquid present in the tub 3.

Figure 9:
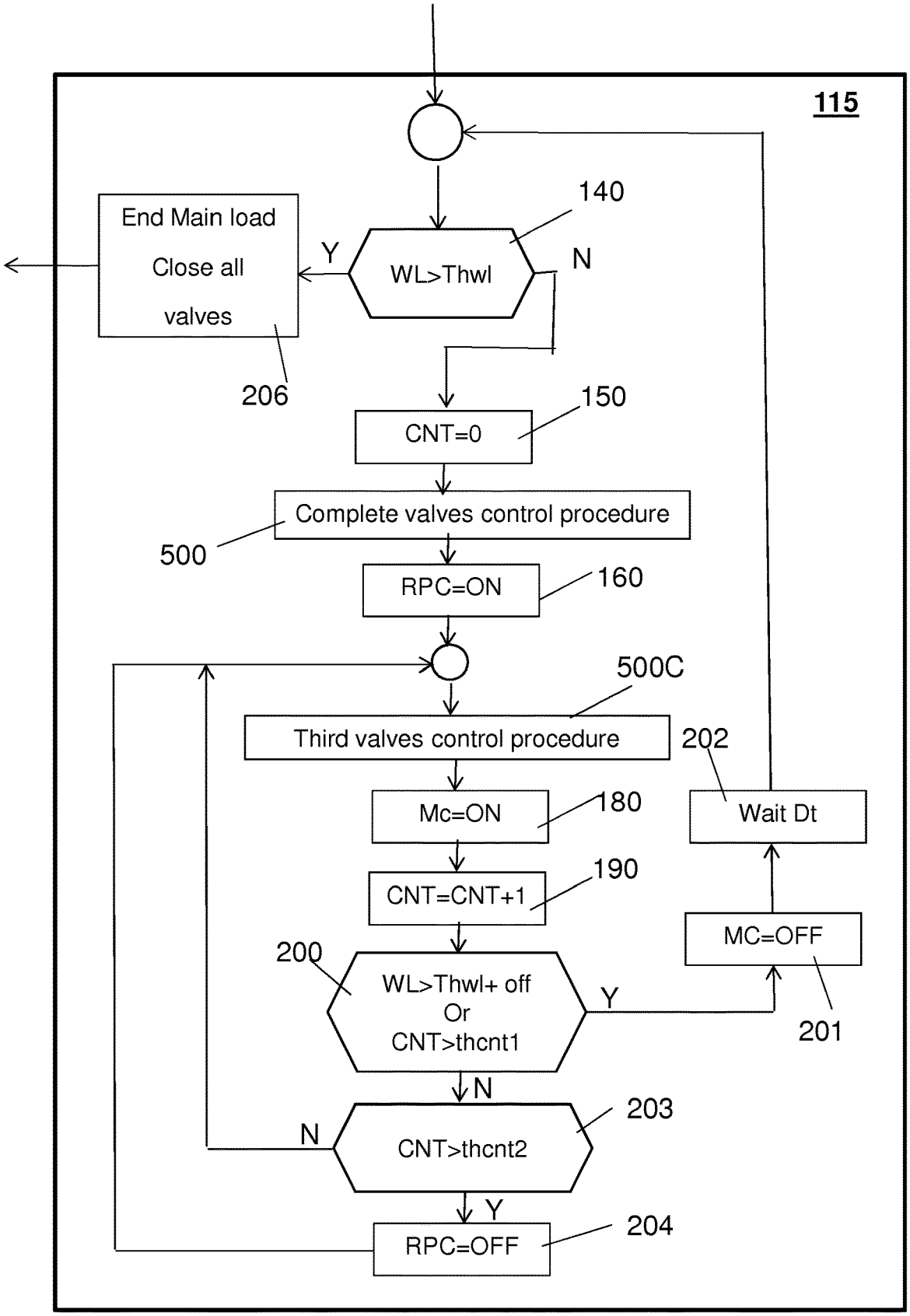

With reference to the FIGS. 3 and 9, after the control device 23 has performed the pre-load water procedure 110, it enters the main load water procedure 115; the control passes to block 140 wherein an inquiry is made through the water level detector 20 to determine if level of water into the washing tub 3, hereinafter indicated with WL, is greater than a prefixed water load threshold Thwl associated with the wetting phase of the performed washing program.

If the answer to the inquiry is affirmative (Yes output from block 140), control device 23 stops the supply of water, i.e. closes the valves 10*a* and 10*b*, if opened, and ends the main load procedure (block 206), and exits block 115.

If the answer to the inquiry is negative (No output form block 140), that is, the level of water WL has not reached the water load threshold Thwl, a counter is set to zero (block 150), and the complete valves control procedure 500 is performed as disclosed above (illustrated in FIG. 4).

After performing the complete valves control procedure 500A, the drain pump 16 is switched on and the electrovalve 27 is activated in such a way to connect the outlet of the drain pump 16 with the recirculation pipe 26 (RPC=ON), so as to drain the washing/rinsing liquid from the bottom of the washing tub 3 and to re-admit such liquid into an upper region of the washing tub 3 for improving the wetting of the laundry (block 160).

Control passes to the block 170 wherein the control device 23 performs the third valves control procedures 500C by implementing the steps likewise the steps disclosed above and illustrated in FIG. 6.

Control passes to the block 180, wherein the electric motor 11 is switched on to start rotating the drum 4 in order to improve the wetting of the laundry.

Control passes to the block 190 wherein the counter CNT is incremented by one.

Control passes to the block 200, wherein an inquiry is made through the water level detector 20 to determine if level of water WL into the washing tub 3 is greater than said prefixed water load threshold Thwl added with a prefixed offset value. In the block 200 the control device 23 further checks if the counter CNT has reached a first pre-established counter threshold thcnt1. It is point out that the first pre-established counter threshold thcnt1 may be associated with a safety water loading maximum time.

If control device 23 determines that water level WL is greater than the prefixed water load threshold Thwl plus the prefixed offset value or that counter CNT has reached the first pre-established counter threshold thcnt1 (out yes block 200), control passes to the block 201, wherein the electric motor 11 is switched off to stop rotation of the drum 4. After stoppage of rotation of the drum 4, control device 23 waits a prefixed ΔT time (block 202) and after such time ΔT, performs again the above disclosed control of block 140.

If control device 23 determines that water level WL is not greater than prefixed water load threshold Thwl plus the offset and that counter CNT has not reached the first pre-established counter threshold thcnt1, control passes to the block 20, wherein an inquiry is made to determine if counter CNT is lower that a second pre-established counter threshold thcnt2. It is point out that second pre-established counter threshold thcnt2 is lower than the first pre-established counter threshold thcnt1 and is associated with the time during which water is recirculated from the bottom to an upper region of the washing tub 3; if counter CNT is greater than thcnt2 (output No from block 203), the drain pump 16 is switched off (block 204), so that water is not recirculated and water level can stabilize; then control passes then to block 500C wherein third valves control procedures 500C is performed again likewise disclosed above and illustrated in FIG. 6.

If counter CNT is lower or equal than thcnt2 (output No from block 203) then control goes back to block 500C.

According to the present invention as described above, since when temperature sensor is not immersed in the liquid, supply of hot and/or cold water is performed in a pre-established supplying order based on temperatures associated with the selected washing program/parameters, and possibly also on air temperature, damages to delicate laundry due to too high water temperature, is prevented.

Moreover, since the temperature of the water supplied into the washing tub is conveniently controlled even when the temperature sensor is not submerged by the water, the following control of wetting phase performed by the control device based on measured temperature is faster than known methods.

It has thus been shown that the present invention allows all the set objects to be achieved.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

The invention claimed is:

1. A laundry treatment machine comprising:

an outer casing, a washing tub which is arranged inside the outer casing, a rotatable washing drum, which is arranged in axially rotating manner inside the washing tub and is structured to receive the laundry to be treated, a liquid supplying system for supplying hot liquid and/or cold liquid into said washing tub, a temperature sensor which is designed for sensing the temperature of the liquid contained in said washing tub; and an electronic control device configured to:

determine whether the temperature sensor is immersed in liquid; and perform a first or a second control procedure, different from one another, to control said liquid supplying system based on a determined immersion status of said temperature sensor.

2. A laundry treatment machine according to claim 1, wherein said electronic control device is configured to:

perform said first control procedure if said temperature sensor is not immersed into liquid; and perform said second control procedure if said temperature sensor is immersed into liquid.

3. A laundry treatment machine according to claim 2, comprising a user interface provided for an operator to select a washing program and/or parameter, wherein in said first control procedure, said control device controls said liquid supplying system in such a way that hot liquid and/or cold liquid is supplied into the washing tub according to a pre-established hot/cold liquid supplying order depending on a selected washing program and/or parameter selected by said user interface.

4. A laundry treatment machine according to claim 3, wherein said selected washing program and/or parameter on which said pre-established hot/cold liquid supplying order depends, is associated with a washing temperature.

5. A laundry treatment machine according to claim 1, wherein said electronic control device is configured to perform a third control procedure wherein said liquid supplying system is controlled based on the temperature sensed by said temperature sensor in the tub.

6. A laundry treatment machine according to claim 5, wherein said electronic control device is configured to perform said third control procedure after performing said first control procedure and after performing said second control procedure.

7. A laundry treatment machine according to claim 5, wherein said selected program and/or parameter on which said pre-established hot/cold liquid supplying order depends is associated with washing temperatures between prefixed maximum and minimum temperatures, wherein in said third control procedure the control device compares said sensed temperature with said maximum and/or minimum temperatures, and controls said liquid supplying system based on the comparison.

8. A laundry treatment machine according to claim 7, wherein said liquid supplying system comprises a first valve for supplying hot liquid and a second valve for supplying cold liquid, wherein in said third control procedure the first valve is opened if the temperature sensed by said temperature sensor is lower than said minimum temperature; and the second valve is opened if the temperature sensed by said temperature sensor is greater than said maximum temperature.

9. A laundry treatment machine according to claim 7, wherein in said second control procedure the control device calculates an average temperature based on said minimum temperature and said maximum temperature, compares temperature sensed by said temperature sensor with said average temperature, and controls said liquid supplying system based on the result of comparison.

10. A laundry treatment machine according to claim 9, wherein in said second control procedure the first valve is opened if the temperature sensed by said temperature sensor is lower than or equal to said average temperature;

and the second valve is opened if the temperature sensed by said temperature sensor is greater than said average temperature.

11. A laundry treatment machine according to claim 1, further comprising an electric heating device arranged in the washing tub for heating the liquid contained in the washing tub, said temperature sensor being integrated in, and supported by, said electric heating device.

* * * * *